United States Patent [19]

Ozeki et al.

[11] Patent Number: 4,993,990

[45] Date of Patent: Feb. 19, 1991

[54] UNACCEPTABLE COIN REMOVING APPARATUS FOR COIN HANDLING MACHINE

[75] Inventors: Masamichi Ozeki, Ashikaga; Katsuyuki Miyamoto, Urawa; Shoichi Uda, Tokyo, all of Japan

[73] Assignee: Laurel Bank Machines CP., Ltd., Tokyo, Japan

[21] Appl. No.: 424,119

[22] Filed: Oct. 19, 1989

[30] Foreign Application Priority Data

Oct. 20, 1988 [JP] Japan ..... 136777
Oct. 6, 1989 [JP] Japan ..... 261736

[51] Int. Cl.[5] ..... G07D 5/02; G07D 5/08

[52] U.S. Cl. ..... 453/7; 433/5; 194/317

[58] Field of Search ..... 453/5, 7, 9, 11; 194/317

[56] References Cited

U.S. PATENT DOCUMENTS

| | | | |
|---|---|---|---|
| 4,460,004 | 7/1984 | Furuya | 194/317 X |
| 4,758,201 | 7/1988 | Ozeki | 453/56 |
| 4,800,997 | 1/1989 | Ozeki et al. | 194/344 |
| 4,844,230 | 7/1989 | Ludwig et al. | 453/9 X |
| 4,861,312 | 8/1989 | Sentoku | 453/7 |
| 4,904,223 | 2/1990 | Sentoku | 453/7 |

FOREIGN PATENT DOCUMENTS

| | | |
|---|---|---|
| 58-92084 | 6/1983 | Japan . |
| 62-59834 | 3/1987 | Japan . |
| 2054932 | 2/1981 | United Kingdom . |
| 2094049 | 9/1982 | United Kingdom . |

*Primary Examiner*—Robert J. Spar

*Assistant Examiner*—Scott L. Lowe

*Attorney, Agent, or Firm*—Fleit, Jacobson, Cohn, Price, Holman & Stern

[57] ABSTRACT

An unacceptable coin removing apparatus for a coin handling machine having a rotatable disk for receiving deposited coins, an annular guide provided on the periphery of the rotatable disk and formed with an opening, a coin sorting passage connected to the opening downstream thereof, a pair of guide plates provided for the coin sorting passage, the space between the pair of guide plates being adjustable and the pair of guide plates being capable of supporting a predetermined denomination of coins in accordance with the space therebetween, a coin collecting opening provided below the pair of guide plates, a coin transporting belt provided in the coin sorting passage for transporting coins by contacting the upper faces of coins in the coin sorting passage, a drive motor for driving the rotatable disk and the coin transporting belt and a sensor provided downstream of the coin collecting opening in the coin sorting passage for detecting the characteristics of the coins, the unacceptable coin removing apparatus further including a first stopper provided downstream of the sensor in the coin sorting passage and capable of preventing coins from being further transported, a second stopper provided downstream of the first stopper in the coin sorting passage and capable of preventing coins from being further transported, and a controller for judging based upon signals input from the sensor whether each coin is acceptable or not. This unacceptable coin removing apparatus can remove unacceptable coins using a simple structure and enables the coin handling machine to be made compact.

3 Claims, 5 Drawing Sheets

UNACCEPTABLE COIN REMOVING APPARATUS FOR COIN HANDLING MACHINE

BACKGROUND OF THE INVENTION

The present invention relates to an unacceptable coin removing apparatus for a coin handling machine having a coin sorting means for sorting coins in accordance with their denominations, and, more particularly, to such an apparatus for a coin handling machine which is capable of removing unacceptable coins such as counterfeit coins or uncurrent coins, is simple in structure and enables the coin handling machine to be made compact.

DESCRIPTION OF THE PRIOR ART

There is known a coin handling machine which is constituted so that coins deposited through a coin deposit opening are fed onto a rotatable disk provided with an annular guide on the periphery thereof, fed one by one to a coin sorting passage comprising a pair of guide plates and a coin collecting opening provided therebelow through an opening formed in the annular guide, while being guided by the inner face of the annular guide, the space between a pair of guide plates being adjusted so that only a predetermined denomination of coins can pass through the coin sorting passage and coins having a diameter smaller than that of the predetermined denomination of coins fall into the coin collecting opening, transported by a coin transporting means so as to be aligned in a row, and the value of coins which did not fall into the coin sorting opening is counted and discrimination is made as to whether the coins are acceptable or not by a sensor provided for the coin sorting passage so that the acceptable coins are sorted in accordance with their denominations and are further wrapped in accordance with their denominations, if necessary.

In this kind the coin handling machine, an unacceptable coin removing apparatus is provided for removing unacceptable coins such as counterfeit coins or uncurrent coins, so that only acceptable coins are sorted and wrapped in accordance with their denominations.

For example, Japanese Patent Publication No. 58-92084 proposes such a kind of coin handling machine. In this machine, a coin transport preventing means is provided downstream of the coin collecting opening in the coin sorting passage for preventing coins following an unacceptable coin from being further transported when an unacceptable coin is detected, and downstream of the coin transport preventing means, there is provided a coin passage for further feeding a predetermined denomination of coins into the coin handling machine, an unacceptable coin removing passage for removing the unacceptable coins and a gate means for feeding coins into either the coin passage or the unacceptable coin removing passage based upon detection signals from the sensor. More specifically, this publication discloses an unacceptable coin removing apparatus in which when an unacceptable coin is detected, the coin transport preventing means is actuated so as to prevent coins following the unacceptable coin from being further transported and at the same time, the coin transporting means is stopped, and the unacceptable coin is fed into the unacceptable coin removing passage by the gate means.

However, since in this prior art machine, there are provided the gate means for separating the unacceptable coins from acceptable coins and removing the unacceptable coins when they are detected, and the unacceptable coin removing passage, there arise problems in that the structure of the coin handling machine becomes complicated and that the size thereof becomes large.

SUMMARY OF THE INVENTION

It is, therefore, an object of the present invention to provide an unacceptable coin removing apparatus for a coin handling machine having a coin sorting means for sorting coins in accordance with their denominations which is capable of removing unacceptable coins such as counterfeit coins or uncurrent coins, is simple in structure and enables the coin handling machine to be made compact.

According to the present invention, the above and other objects can be accomplished by an unacceptable coin removing apparatus for a coin handling machine comprising a rotatable disk for receiving deposited coins, annular guide means provided on the periphery of said rotatable disk and formed with an opening, coin sorting passage means connected to said opening downstream thereof, a pair of guide plate means provided for said coin sorting passage means, the space between said pair of guide plate means being adjustable and said pair of guide plate means being capable of supporting a predetermined denomination of coins in accordance with the space therebetween, a coin collecting opening provided below said pair of guide plate means, coin transporting means provided in the coin sorting passage means for transporting coins by contacting the upper faces of coins in the coin sorting passage means, drive means for driving said rotatable disk and said coin transporting means and sensor means provided downstream of said coin collecting opening in the coin sorting passage means for detecting the characteristics of the coins, said unacceptable coin removing apparatus comprising first stopper means provided downstream of said sensor means in the coin sorting passage means and capable of preventing coins from being further transported, second stopper means provided downstream of said first stopper means in the coin sorting passage means and capable of preventing coins from being further transported, and control means for judging based upon signals input from said sensor means whether each coin is acceptable or not, said control means being constituted so that when it judges that the coin is an unacceptable coin, it drives said first stopper means and said second stopper means so as to prevent the unacceptable coin from being further transported by the second stopper means and prevent coins following the unacceptable coin from being transported by said first stopper means, thereafter drives said drive means to enable said rotatable disk and said coin transporting means to drive so that the following coins can be returned onto the rotatable disk and, after the following coins have been returned onto the rotatable disk, sets the space between said pair of guide plate means larger than the largest diameter of coins to be handled, drives said first stopper means and said second stopper means in the reverse direction and drives said coin transporting means so as to feed said unacceptable coin toward said rotatable disk.

DESCRIPTION OF THE PREFERRED EMBODIMENTS

Figure 1:
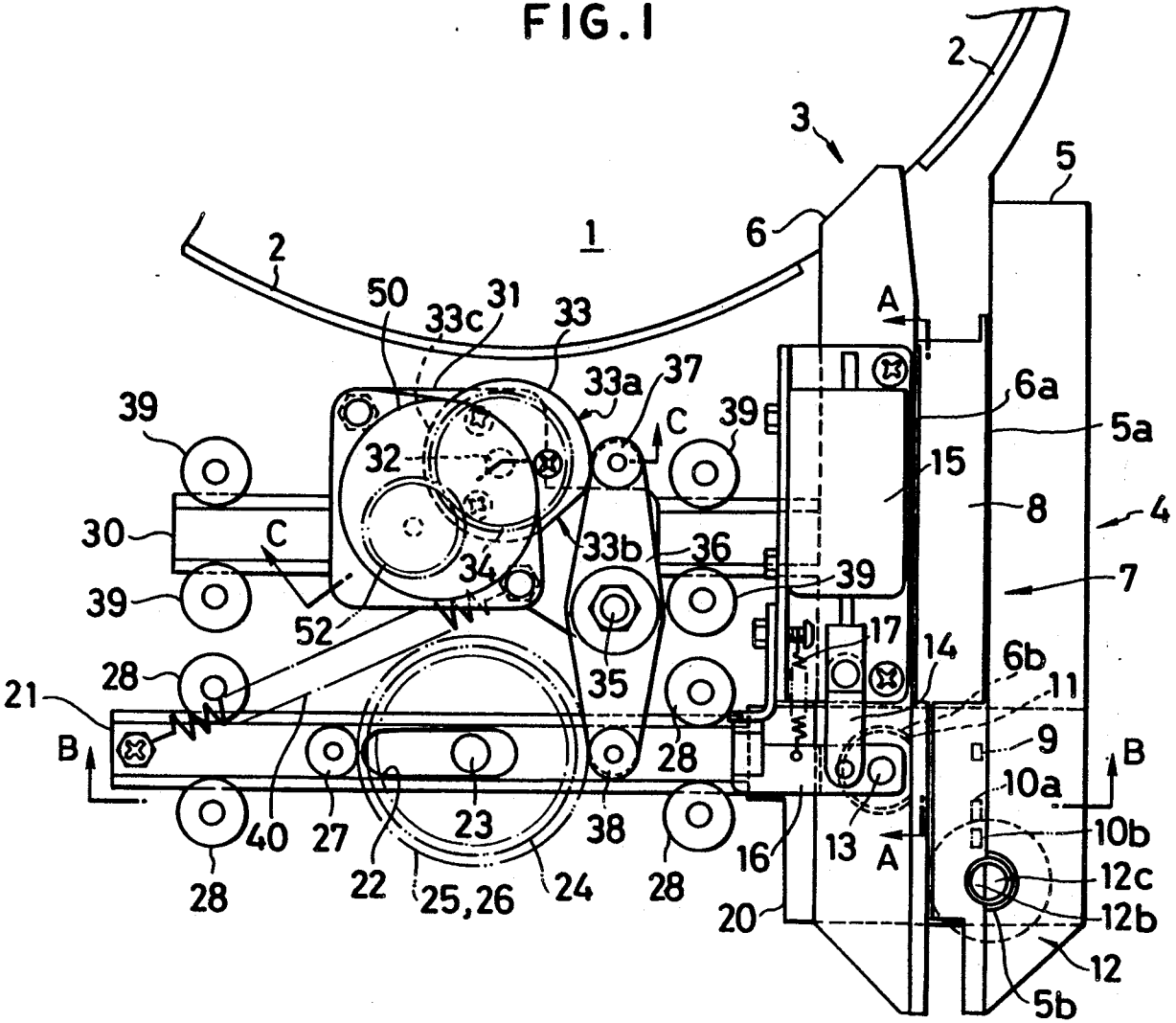
FIG. 1 is a schematic drawing showing a plan view of a coin handling machine including an unacceptable coin removing apparatus which is an embodiment of the present invention.

Referring to FIG. 1, an unacceptable coin removing apparatus for a coin handling machine which is an embodiment of the present invention is provided with a rotatable disk 1 for receiving coins deposited through a coin deposit opening (not shown) from a coin feed belt (not shown) onto the upper face thereof and an annular guide 2 disposed along a circumference of the rotatable disk 1 and a part of the annular guide is formed with an opening 3. Downstream of the opening 3 of the annular guide 2, a coin sorting apparatus 4 is connected for sorting the coins in accordance with their denominations. Coins deposited through the coin deposit opening and fed to the rotatable disk 1 via the coin feed belt are further fed along the inner face of the annular guide 2 to the opening 3 by centrifugal force produced by the rotation of the rotatable disk 1 and further fed one by one to the coin sorting apparatus 4.

In the coin sorting apparatus 4, there are provided a pair of guide plates 5, 6, the space therebetween being adjustable, and guide rails 5*a*, 6*a* are secured to the bottom faces of the pair of guide plates 5, 6 respectively, whereby a coin sorting passage 7 is formed between the pair of guide plates 5, 6. Below the pair of guide plates 5, 6, a coin collecting opening 8 is formed and coins of smaller diameter than the space between the guide rails 5*a*, 6*a* fall into the coin collecting opening 8 and are collected by a collecting means (not shown). The space between the pair of guide plates 5, 6 is set to be larger than the largest diameter of coins to be handled so as to enable feeding of all coins deposited into the coin handling machine into the coin sorting passage 7 and so that only the largest diameter coins to be handled can be transported in the coin sorting passage 7, with the edges thereof being supported by the guide rails 5*a*, 6*a*, and coins of the other denominations fall into the coin collecting opening 8. An end of the guide plate 6 on the side of the rotatable disk 1 is formed with a taper so that coins can be smoothly fed from the rotatable disk 1 into the coin sorting passage 7. Further, above the coin sorting passage 7, there is provided a transporting belt (not shown) engaged with pulleys (not shown) for transporting the coins fed from the rotatable disk 1 via the opening 3 of the annular guide 2 in the coin sorting passage 7, while holding them between itself and the guide rails 5*a*, 6*a*. Downstream of the coin collecting opening 8 in the coin sorting passage 7, the guide rail 5*a* is arranged so as to project at a position adjacent to the guide rail 6*a*. In the coin sorting passage 7 downstream of the coin collecting opening 8, a first sensor 9 is provided for discriminating the genuineness of the coins by detecting the magnetic characteristics of the coins passing thereon and outputting detection signals to a control unit (not shown) and downstream of the first sensor 9, a pair of second sensors 10*a*, 10*b* are provided for counting the number of the deposited coins by detecting change in magnetic flux density of the coins passing thereon and outputting detection signals to the control unit. The control unit increases a counting value of the coins stored in RAM (not shown) of the control unit by one when the detection signal is input from the third sensor 10*b* immediately after the detection signal was input from the second sensor 10 *a*, and on the contrary, decreases it by one when the detection signal is input from the second sensor 10*a* immediately after the detection signal was input from the third sensor 10*b*.

Further, a rotatable first stopper 11 is provided in the coin sorting passage 7 downstream of the coin collecting opening 8 and upstream of the sensors 10*a*, 10*b* and a rotatable second stopper 12 is provided in the coin sorting passage 7 downstream of the second sensors 10*a*, 10*b*. Although not shown, downstream of the coin sorting passage 7, there are provided a coin stacking section for stacking a predetermined number of coins and a coin wrapping section for wrapping the coins stacked by the coin stacking section.

Figure 2:
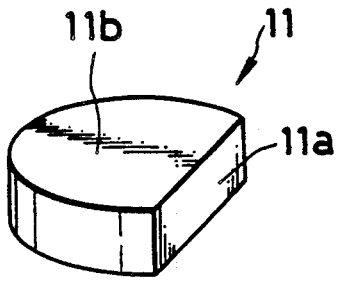
FIG. 2 is a schematic drawing showing a perspective view of a first stopper.
Figure 3:
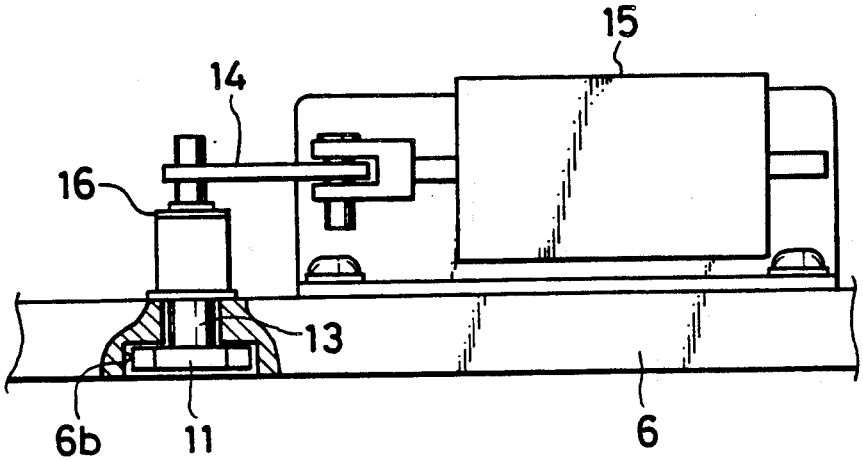
FIG. 3 is a schematic drawing showing a cross-sectional view taken on line A—A of FIG. 1.

FIG. 2 is a schematic drawing showing a perspective view of the first stopper 11. As shown in FIG. 2, the first stopper 11 is formed by cutting a circular plate along a plane parallel to its axis. As shown in FIG. 1, the guide plate 6 is formed with a first stopper receiving section 6*b* having circular shape and the first stopper 11 is normally received within the first stopper receiving section 6*b* so that its flat side face 11*a* is positioned on the same plane as the side face of the guide plate 6 facing the guide plate 5. As shown in FIGS. 1 and 3, the first stopper 11 is fixed to the lower end of a shaft 13 and a lever 16 is fixed via a link 14 to the upper end of the shaft 13, the lever being connected to a plunger of a solenoid 15. A tension spring 17 is secured to the opposite side of the lever 16 to the portion thereof fixed to the shaft 13 with respect to the portion thereof secured to the link 14, the tension spring 17 being fixed to the body of the coin handling machine at one end, and the lever 16 is biased about the shaft 13 clockwise in FIG. 1. Therefore, the first stopper 11 is normally received within the first stopper receiving section 6*b* under the biasing force of the tension spring 17. When the control unit detects a counterfeit coin or uncurrent coin based upon the signal from the first sensor 9, it drives the solenoid 15 so as to swing the lever 16 counterclockwise about the shaft 13 via the plunger and the link 14 and, as a result, the thus constituted first stopper 11 is rotated counterclockwise about the shaft 13 so that its projecting portion 11*b* projects into the coin sorting passage 7.

Figure 4:
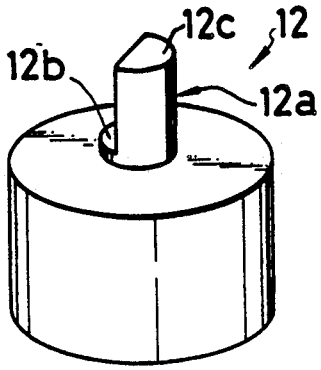
FIG. 4 is a schematic drawing showing a perspective view of a second stopper.

FIG. 4 is a schematic drawing showing a perspective view of the second stopper 12. As shown in FIG. 4, the second stopper 12 is constituted by a rotary solenoid having an actuating bar 12*a* and is formed by cutting the actuating bar 12*a* along a plane parallel to its axis so that a bottom portion 12*b* remains and comprises the bottom portion 12*b* and a projection portion 12*c*. The guide plate 5 is formed with a second stopper receiving section 5*b* having a circular shape and the projection portion 12*c* of the actuating bar 12*a* of the second stopper 12 is normally received within the second stopper receiving section 5*b* so that the flat side face of the projection portion 12*c* of the actuating bar 12*a* is positioned on the same plane as the side face of the guide plate 5 facing the guide plate 6. When the control unit detects a counterfeit coin or an uncurrent coin based upon the input signal from the first sensor 9, the control unit applies an electric current to the rotary solenoid and rotates the second stopper 12 so that the projection portion 12*c* of the actuating bar 12*a* projects into the coin sorting passage 7, thereby to prevent the counterfeit coin or the uncurrent coin from being further transported downstream. Further, the upper face of the bottom portion 12*b* of the actuating bar 12*a* is positioned on the same plane as the upper face of the coin sorting passage 7.

The control unit is constituted so that when it detects a counterfeit coin or an uncurrent coin based upon the input signal from the first sensor 9, it enables a drive means to stop the rotation of the rotatable disk 1 and the movement of the transporting belt.

Accordingly, when the control unit detects a counterfeit coin or an uncurrent coin based upon the input signal from the first sensor 9, the counterfeit coin or the uncurrent coin is prevented by the second stopper 12 from being further transported downstream and the coins following the counterfeit coin or the uncurrent coin are prevented by the first stopper 11 from being transported downstream of the first stopper 11. At the same time, since transport of coins is stopped, only the counterfeit coin or the uncurrent coin is held between the first stopper 11 and the second stopper 12.

Next, the control unit drives the drive means to rotate the rotatable disk 1 and the transporting belt in the reverse direction, thereby to return onto the rotatable disk 1 the coins following the counterfeit coin or the uncurrent coin which have been prevented from being transported. Thus, after all the following coins have been returned onto the rotatable disk 1, as explained later, the control unit adjusts the space between the pair of guide plates 5, 6 so that the space between the guide rails 5*a*, 6*a* is made larger than the largest diameter coins to be handled, and drives the solenoid 15, thereby to rotate the first stopper 11 clockwise about the shaft in FIG. 1 and return it to its normal position. As a result, the counterfeit coin or the uncurrent coin which has been held between the first stopper 11 and the second stopper 12 up to now is transported in the reverse direction within the coin sorting passage 7, falls into the coin collecting opening 8 and is collected by the coin collecting means (not shown).

On the other hand, when the control unit judges based upon the input signal from the first sensor 9 that a predetermined number of coins have been fed to the coin stacking section, it applies an electric current to the rotary solenoid constituting the second stopper 12, thereby to rotate the second stopper 12 and at the same time, enables the drive means to stop the rotation of the rotatable disk 1 and the movement of the transporting belt. Then, after a predetermined time period, the control unit rotates the second stopper 12 in the reverse direction by driving the rotary solenoid, thereby to return the second stopper 12 to its normal position and at the same time, restarts the rotation of the rotatable disk 1 and the movement of the transporting belt by driving the drive means, thereby to restart feed-in operation of coins from the rotatable disk 1 via the coin sorting passage 7 to the coin stacking section.

Figure 5:
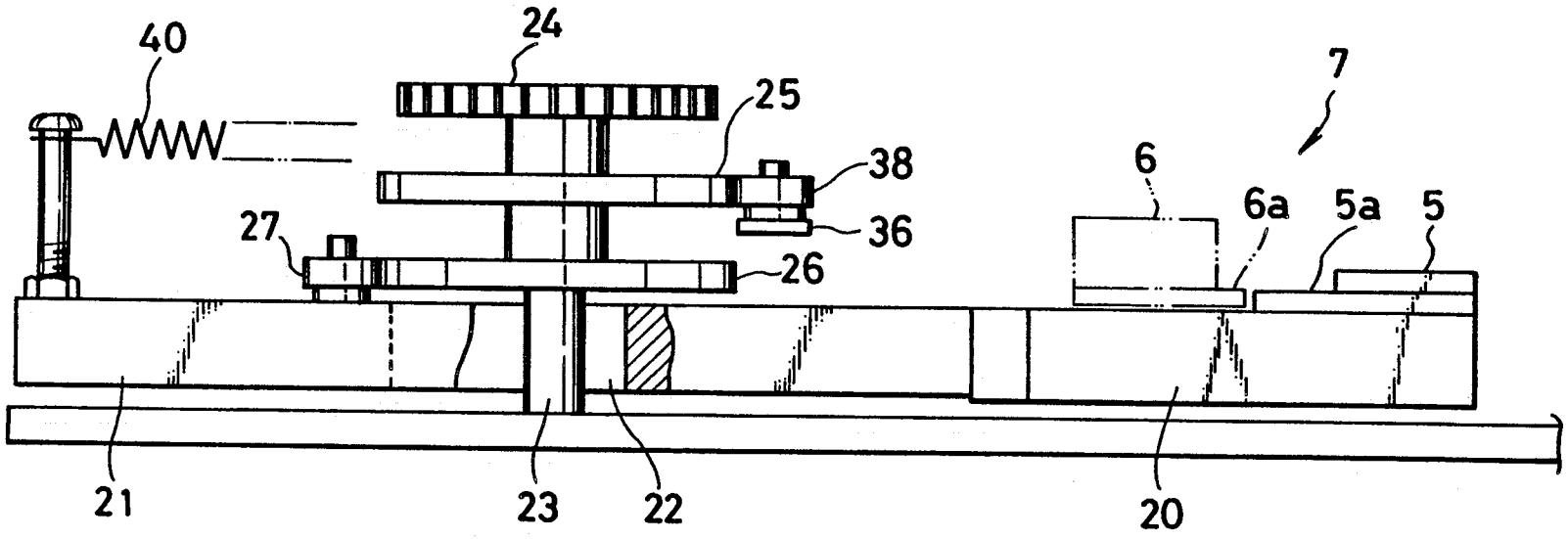
FIG. 5 is a schematic drawing showing a cross-sectional view taken on line B—B of FIG. 1.

Further, there is provided a space adjusting mechanism for adjusting the space between the pair of guide plates 5, 6 which comprises a first slide member 21 fixed to a block 20 fixed to the guide plate 5, extending in a direction perpendicular to the longitudinal direction of the guide plate 5 and slidable in its own longitudinal direction. As shown in FIGS. 1 and 5, substantially the central portion of the first slide member 21 is formed with a slot 22 through which a shaft 23 secured to the body of the coin handling machine extends in the vertical direction. There are fixed a gear 24, a cam 25 and a cam 26 operable by an operator via a gear (not shown) to the shaft 23. In FIG. 1, the cam 25 and the cam 26 are drawn circular for simplifying the drawing. Further, a cam follower 27 abutting against the lobe of the cam 26 is fixed to the first slide member 21. Moreover, four guide rollers 28, 28, 28, 28 are provided on the both sides of the first slide member 21 for restricting the direction along which the first slide member 21 slides.

Figure 6:
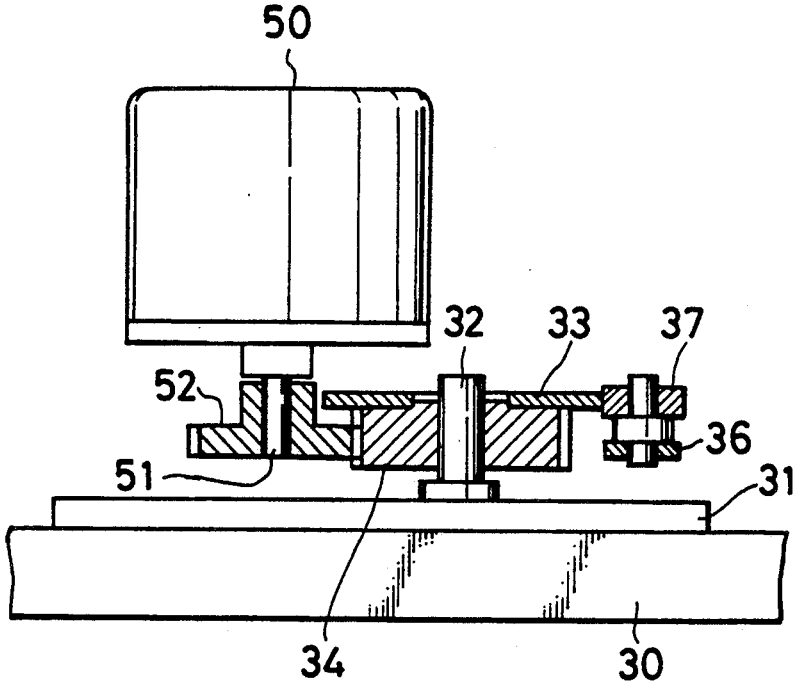
FIG. 6 is a schematic drawing showing a cross-sectional view taken on line C—C of FIG. 1.

On the other hand, there is fixed to the guide plate 6 a second slide member 30 extending in a direction perpendicular to the longitudinal direction of the guide plate 6 and slidable in the direction. As shown in FIGS. 1 and 6, a plate member 31 is fixed to the second slide member 30, a shaft 32 extending vertically is mounted on the plate member 31, a gear 34 is fixed to the shaft 32, and a cam 33 is fixed to the upper face of the gear 34. Further, a shaft 35 is fixed to the plate member 31 and a swing lever 36 is secured to the plate member 31 so as to be swingable about the shaft 35. On the opposite end portions of the swing lever 36, there are provided a cam follower 37 abutting against the lobe of the cam 33 and a cam follower 38 abutting against the cam 25, whereby the clockwise swinging movement of the swing lever 36 is restricted by the cam 25 and the counterclockwise swinging movement thereof is restricted by the cam 33. On the both sides of the second slide member 30, four guide rollers 39, 39, 39, 39 are provided for restricting the direction along which the second slide member 30 slides.

Further, as shown in FIG. 1, a tension spring 40 is secured to the first slide member 21 at one end thereof and the other end of the tension spring 40 is secured to the plate member 31, whereby the cam follower 27 is biased toward the cam 26 and the cam follower 38 is biased toward the cam 25.

Moreover, as shown in FIG. 6, a gear 52 fixed to a drive shaft 51 of a motor 50 is engaged with the gear 34 fixed to the shaft 32 secured to the plate member 31.

Figure 7A:
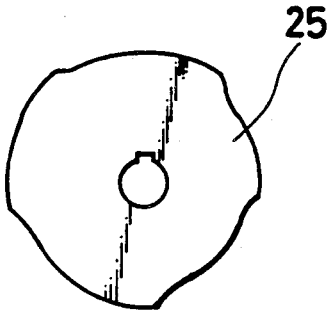
FIGS. 7(*a*) and (*b*) are schematic drawings showing plan views of cams.
Figure 7B:
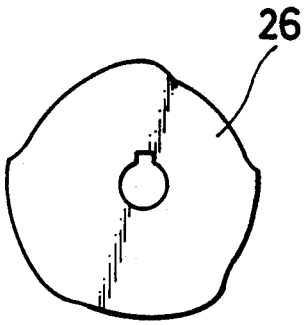

In the thus constituted space adjusting mechanism, when the operator operates a denomination setting dial in an operation section (not shown), the gear 24 is rotated via the gear (not shown), whereby the cam 25 and the cam 26 respectively fixed to the shaft 23 on which the gear 24 is mounted are rotated in a predetermined direction. When the cam 26 is rotated, the cam follower 27 is moved in the longitudinal direction of the first slide member 21 with abutting the lobe of the cam 26 and consequently the first slide member 21 is also moved, whereby the guide plate 5 is moved. At the same time, the cam 25 is rotated, whereby the cam follower 38 is moved in the longitudinal direction of the first slide member 21. As shown in FIG. 7 (*a*) and (*b*), the lobes of the cam 25 and the cam 26 are formed so that when the gear 24 is rotated by a predetermined amount, as a result of the operator rotating the denomination setting dial by a predetermined amount, the guide plate 5 and the guide plate 6 are moved in the opposite directions to each other by the same distance. Therefore, it is possible to set the space between the guide plates 5, 6 by adjusting the denomination setting dial so that the guide rails 5*a* and 6*a* can support only the edges of a predetermined denomination of coins and that all of the other denominations of coins fall into the coin collecting opening 8.

Further, as shown in FIG. 1, the lobe of the cam 33 is formed with a convex portion 33*a* and a concave portion 33*b*. In the case where the cam follower 37 abuts against the convex portion 33*a*, the space between the guide plates 5, 6 can be set by adjusting the denomination setting dial by the operator so that the guide rails 5*a*, 6*a* can support only the edges of a set denomination of coins and all of the other denominations of coins fall into the coin collecting opening 8, and, on the other hand, in the case where the cam follower 37 abuts against the concave portion 33*b*, the space between the guide rails 5*a*, 6*a* is set to be maximum so that all the coins to be handled fall into the coin collecting opening 8.

Figure 8:
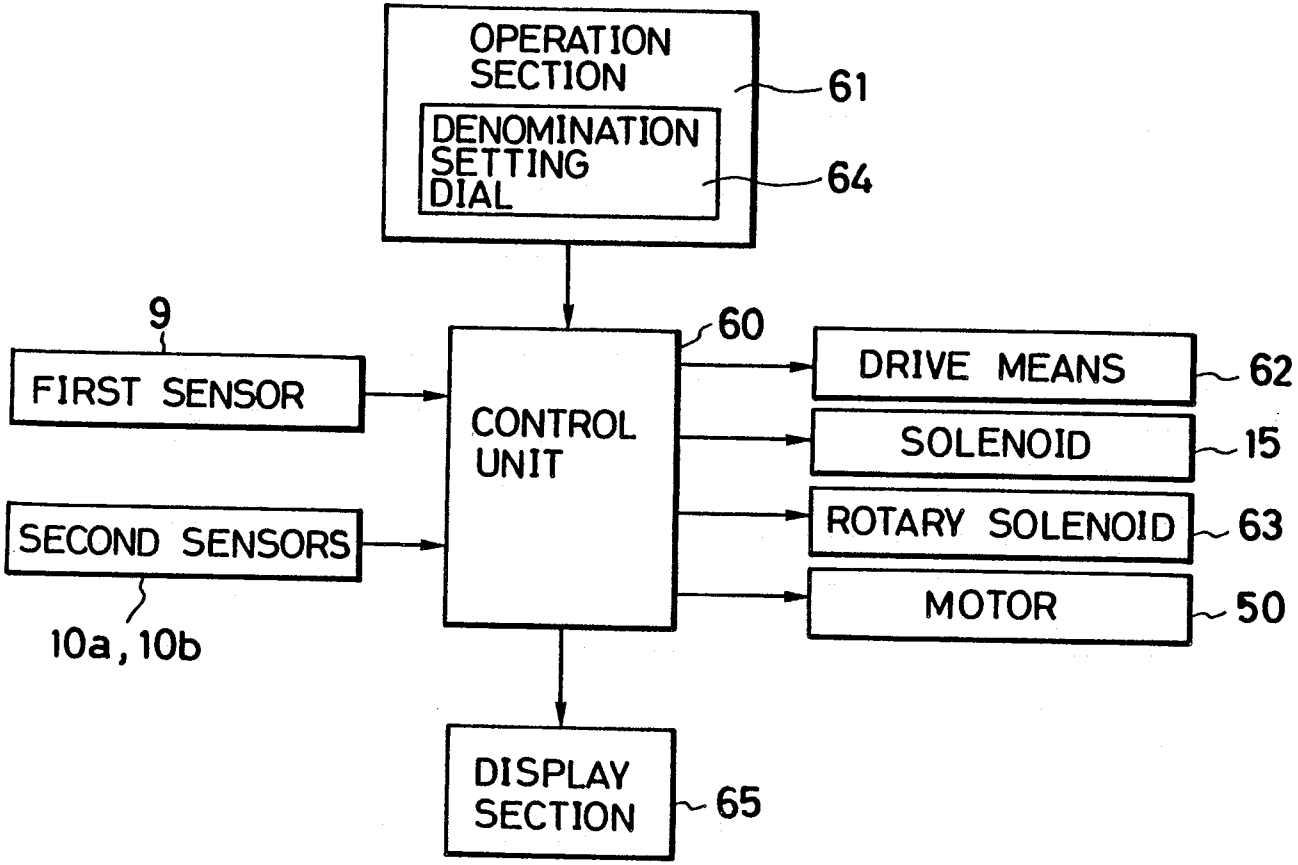
FIG. 8 is a block diagram showing detection, control, drive, input and output systems of an unacceptable coin removing apparatus which is an embodiment of the present invention.

FIG. 8 is a block diagram showing detection, control, drive, input and output systems of the unacceptable coin removing apparatus which is an embodiment of the present invention.

Referring to FIG. 8, the detection signals detected by the first sensor 9 and the second sensors 10*a*, 10*b* are input to the control unit 60 and instruction signals input by the operator from an operation section 61 are input to the control unit 60. On the other hand, the control unit 60 outputs various drive signals to the drive means 62 for rotating the rotatable disk 1 and moving the transporting belt, a solenoid 15 for rotating the first stopper 11, the rotary solenoid 63 constituting the second stopper 12 and the motor 50. The denomination setting dial 64 is provided in the operation section 61 and is connected to the gear 24 via the gear (not shown). Further, a display section 65 is provided for receiving alarm signals from the control unit 60 and displaying an alarm when a counterfeit coin or an uncurrent coin is detected based upon the detection signals of the first sensor 9 and the sensors 10*a*, 10*b*.

In the thus constituted unacceptable coin removing apparatus for the coin handling machine which is an embodiment of the present invention, at first, the denomination setting dial 64 is operated by the operator, whereby the gear 24, the cam 25 and the cam 26 are rotated by predetermined amounts and the first slide member 21 and the second slide member 30 are moved so that the space between the guide plates 5, 6 is set to be slightly larger than the largest diameter of coins to be handled and the guide rails 5*a*, 6*a* can support the edges of only the largest diameter of coins.

Afterward, when coins have been deposited through the coin deposit opening into the coin handling machine and a start signal has been input from the operation section 61, the control unit 60 moves the coin feed belt (not shown) to feed the deposited coins onto the rotatable disk 1 and synchronously drives the drive means 62 to rotate the rotatable disk 1 and move the transporting belt. As a result, the coins fed onto the rotatable disk 1 are fed one by one along the inner face of the annular guide 2 by the centrifugal force produced by the rotation of the rotatable disk 1 to the coin sorting passage 7 formed between the pair of guide plates 5, 6 of the coin sorting apparatus 4 via the opening 3 of the annular guide 2. Since the space between the pair of guide plates 5, 6 is set to a predetermined value larger than the largest diameter of coins to be handled by the denomination setting dial 64, all the deposited coins are fed into the coin sorting passage 7. On the other hand, however, since the space between the guide rails 5*a*, 6*a* is set by the denomination setting dial 64 so that only the largest diameter coins can be supported by the guide rails 5*a*, 6*a* at the edges thereof and pass by the coin sorting passage 7, all coins of the other denominations fall into the coin collecting opening 8 and are collected by the coin collecting means (not shown).

Then, the first sensor 9 detects the magnetic characteristics of the coins which did not fall into the coin collecting opening 8 and have been transported in the coin sorting passage 7 and outputs the detection signal to the control unit 60. The genuine coins which have passed the first sensor 9 are further fed to the pair of second sensors 10*a*, 10*b* which detect change in magnetic flux density and output the detection signals to the control unit 60. When the detection signal is input from the third sensor 10*b* immediately after the detection signal was input from the second sensor 10*a*, the control unit 60 increases the number of the deposited coins of the set denomination stored in the RAM (not shown) by one. Then, the coins are further fed to the coin stacking section.

Thus, when the control unit 60 judges based upon the input signals from the sensors 10*a*, 10*b* that a predetermined number of coins have been fed to the coin stacking section, it drives the rotary solenoid 63 to rotate the second stopper 12 so that the projection portion 12*c* of the actuating bar 12*a* is moved into the coin sorting passage 7 to prevent further coins from being fed to the coin stacking section and at the same time, outputs a drive stop signal to the drive means 62 to stop the rotation of the rotatable disk 1 and the movement of the transporting belt. After a predetermined time has passed and when the coins stacked in the coin stacking section have been fed to the coin wrapping section, the control unit 60 drives the rotary solenoid 63 so that the second stopper 12 is rotated in the reverse direction and the projection portion 12*c* of the actuating bar 12*a* is retracted from the coin sorting passage 7 and received into the second stopper receiving section 5*b*. The coins which have been fed to the coin wrapping section are wrapped in a roll form and a wrapped coin roll is obtained.

On the contrary, in the case where the control unit 60 detects an unacceptable coin such as a counterfeit coin or an uncurrent coin based upon the input signal from the first sensor 9, the control unit 60 drives the rotary solenoid 63 to rotate the second stopper 12 so that the projection portion 12*c* of the actuating bar 12*a* is moved into the coin sorting passage 7 and the unacceptable coin, e.g. a counterfeit coin or an uncurrent coin, is prevented from being fed to the coin stacking section. At the same time, the control unit 60 drives the solenoid 15 to swing the swing lever 16 counterclockwise about the shaft 13 in FIG. 1 via the plunger and the link 14 so that the first stopper 11 is rotated counterclockwise about the shaft 13 and moved into the coin sorting passage 7 from the first stopper receiving section 6*b*, whereby the coins following the unacceptable coin are prevented by the first stopper 11 from being further transported, and the control unit 60 outputs the drive stop signal to the drive means 62 to stop the rotation of the rotatable disk 1 and the movement of the transporting belt. As a result, only the unacceptable coin is held between the first stopper 11 and the second stopper 12.

Then, the control unit 60 outputs a reverse drive signal to the drive means 62 to rotate the rotatable disk 1 and move the transporting belt in the reverse direction, thereby to return the following coins prevented by the first stopper 11 from being transported onto the rotatable disk 1. After a predetermined time has passed and all the following coins which were fed into the coin sorting passage 7 and prevented by the first stopper 11 from being transported have been returned onto the rotatable disk 1, the control unit 60 outputs a drive signal to the motor 50 so as to rotate the cam 33 clockwise about the shaft 32 in FIG. 1. Consequently, the cam follower 37 which has butted against the convex portion 33*a* of the cam 33 abuts against the concave portion 33*b* of the cam 33 via a circumferential portion 33*c* thereof. In accordance with such change in position where the cam follower 37 abuts against the lobe of the cam 33, the space between the guide plates 5, 6 and the space between the guide rails 5*a*, 6*a* gradually becomes greater, and these spaces become maximum and the space between the guide rails 5*a*, 6*a* becomes larger than the largest diameter of coins to be handled in the state where the cam follower 37 abuts against the concave portion 33*b* of the cam 33. When the control unit 60 detects such a state based upon the amount of rotation of the motor 50, it stops the driving of the motor 50. At the same time, the control unit 60 drives the solenoid 15 to swing the swing lever 16 clockwise about the shaft 13 and rotate the first stopper 11 clockwise about the shaft so that the first stopper 11 is received in the first stopper receiving section 6*b* and simultaneously, drives the rotary solenoid 63 to reversely rotate the second stopper 12, whereby the projection portion 12*c* of the actuating bar 12*a* is retracted from the coin sorting passage 7 and received in the second stopper receiving section 5*b*. As a result, the unacceptable coin which has been held between the first stopper 11 and the second stopper 12 is transported toward the rotatable disk 1 by the transporting belt moving reversely and falls into the coin collecting opening 8, whereby it is collected by an unacceptable coin collecting means (not shown). In this case, since the thus collected unacceptable coin was once counted by the sensors 10*a*, 10*b* as a coin which had been accepted by the coin handling machine, when the unacceptable coin is fed back toward the coin collecting opening 8 and the control unit 60 receives the detection signal from the second sensor 10*a* immediately after it receives the detection signal from the second sensor 10*b*, the control unit 60 decreases the count value of accepted coins stored in the RAM by one.

Thus, after a predetermined time period has passed and the unacceptable coin falls into the coin collecting opening 8, the control unit 60 drives the motor 50 to further rotate the cam 33 until the cam follower 37 abuts against the convex portion 33*a* of the cam 33 and stops it at the position where the space between the guide plates 5, 6 becomes a set value which enables only the largest diameter coins to be fed to the coin stacking section via the coin sorting passage 7. At the same time, the control unit 60 drives the drive means 62 to rotate the rotatable disk 1 and the transporting belt in the normal direction, whereby the operation for sorting the coins on the rotatable disk 1 is restarted.

Thus, when all the largest diameter coins have been wrapped, the control unit 60 outputs a wrapping completion signal to the display section 65 to display the information that the wrapping operation has been completed.

Afterward, if necessary, the coins collected by the coin collecting means (not shown) via the coin collecting opening 8 are deposited into the coin handling machine through the coin deposit opening (not shown) again and the largest diameter coins deposited are sorted from the other denominations of coins, stacked in the coin stacking section and further wrapped in a roll form in the coin wrapping section. Similar operation is repeated as occasion demands.

According to the above described embodiment, in the case where unacceptable coins such as counterfeit coins or uncurrent coins are erroneously deposited into the coin handling machine, since the unacceptable coins can be collected by use of the coin collecting opening 8 for collecting coins of other denominations than those to be sorted for being stacked and wrapped, it is neither necessary to provide an independent unacceptable coin collecting passage nor a gate for selectively feeding acceptable coins and unacceptable coins to different passages, and, therefore, it is possible to remove unacceptable coins using a simple structure, thereby enabling the coin handling machine to be made compact.

As described above with reference to the preferred embodiment, it is possible to provide an unacceptable coin removing apparatus for a coin handling machine capable of removing unacceptable coins using a simple structure and enabling the coin handling machine to be made compact.

The present invention has thus been shown and described with reference to a specific embodiment. However, it should be noted that the present invention is in no way limited to the details of the described arrangements but changes and modifications may be made without departing from the scope of the appended claims.

For example, in the above described embodiment, although the space between the guide plates 5, 6 is set to be larger than the largest diameter of coins to be handled so as to be able to feed the coins to be handled into the coin sorting passage 7 and so that only the largest diameter coins can be fed within the coin sorting passage 7 while being supported by the guide rails 5*a*, 6*a* at the edges thereof and that all coins of other denominations fall into the coin collecting opening 8, it is possible to set the space between the pair of guide plates 5, 6 so that only a predetermined denomination of coins set by the denomination setting dial 64 can be supported by the guide rails 5*a*, 6*a* and coins of smaller diameter fall into the coin collecting opening 8. In this case, although coins of larger diameter than that of the predetermined coins cannot enter into the coin sorting passage 7 and remain on the rotatable disk 1, these coins can be fed into the coin sorting passage 7 and sorted by setting the space between the guide plates 5, 6 by operating the denomination setting dial 64 so that these coins can be supported by the guide rails 5*a*, 6*a*. Otherwise, these coins remaining on the rotatable disk 1 may be removed after opening the coin handling machine. In the latter case, it is very convenient to provide a remaining coin removing mechanism comprising a swingable lever or the like capable of catching the remaining coins on the rotatable disk 1 and feeding them into a remaining coin collecting opening for removing the remaining coins from the rotatable disk 1. Further, this remaining coin removing mechanism can be utilized for removing coins from the rotatable disk 1 which have been erroneously deposited into the coin handling machine and having larger diameter than that of the largest diameter coins to be handled.

Further, in the above described embodiment, although the pair of movable guide plates 5, 6 are employed, a fixed guide plate and a movable guide plate may be employed and the space between them may be adjusted by moving the movable guide plate.

Furthermore, in the above described embodiment, although the guide rails 5*a*, 6*a* are secured to the bottom face of the pair of guide plates 5, 6 for supporting the edges of the largest diameter coins to be handled and determining the width of the coin collecting opening 8, plate-like portions may be integrally formed in the vicinity of the bottoms of the pair of guide plates 5, 6 so as to face each other in place of the guide rails 5*a*, 6*a*.

Further, in the above described embodiment, although the guide plate 6 is formed with a taper at the entrance portion of the coin sorting passage 7 for smoothly feeding coins into the coin sorting passage 7, a rotatable guide roller may be provided in the vicinity of the end of the guide plate 6 on the side of the rotatable disk 1 instead of or in addition to the taper.

Furthermore, it is possible to further provide in the vicinity of entrance portion of the coin sorting passage 7 a double feed preventing member which allows the space between itself and the upper face of the rotatable disk 1 to be adjusted, and to set the space between the double feed preventing member and the upper face of the rotatable disk 1 to be greater than the thickness of the thickest coins to be handled and smaller than double thickness of the thinnest coins to be handled for ensuring that coins will always be fed into the coin sorting passage 7 one by one.

Moreover, in the above described embodiment, although the first stopper 11 and the second stopper 12 are simultaneously rotated in the reverse direction and received in the first stopper receiving section 6*b* and the second stopper receiving section 5*b* respectively for removing and collecting an unacceptable coin held between the first stopper 11 and the second stopper 12, it is possible to remove the unacceptable coin by reversely rotating only the first stopper 11 to be received in the first stopper receiving section 6*b* and, therefore, it is sufficient to complete the reverse rotation of the second stopper 12 before the coin sorting operation is restarted.

Further, in the above described embodiment, although the first stopper 11 is formed by cutting a part of a circular plate along the plane parallel to its shaft and the second stopper 12 is constituted by the rotary solenoid 63, it is possible to constitute the first stopper 11 by a rotary solenoid and form the second stopper 12 by cutting a circular plate. Further, the both stoppers may be formed by cutting circular plates or constituted by rotary solenoids.

We claim:

1. An unacceptable coin removing apparatus for a coin handling machine comprising a rotatable disk for receiving deposited coins, annular guide means provided on the periphery of said rotatable disk and formed with an opening, coin sorting passage means connected to said opening downstream thereof, a pair of guide plate means provided for said coin sorting passage means, a space between said pair of guide plate means being adjustable and said pair of guide plate means being capable of supporting a predetermined denomination of coins in accordance with the space therebetween, a coin collecting opening provided below said pair of guide plate means, coin transporting means provided in the coin sorting passage means for transporting coins by contacting upper faces of coins in the coin sorting passage means, drive means for driving said rotatable disk and said coin transporting means and sensor means provided downstream of said coin collecting opening in the coin sorting passage means for detecting characteristics of coins, said unacceptable coin removing apparatus comprising first stopper means provided downstream of said sensor means in the coin sorting passage means and capable of preventing coins from being further transported, second stopper means provided downstream of said first stopper means in the coin sorting passage means and capable of preventing coins from being further transported, and control means for judging based upon signals input from said sensor means whether each coin is acceptable or not, said control means being constituted so that when it judges that the coin is an unacceptable coin, it drives said first stopper means and said second stopper means so as to prevent the unacceptable coin from being further transported by the second stopper means and prevents coins following the unacceptable coin from being transported by said first stopper means, thereafter drives said drive means to enable said rotatable disk and said coin transporting means to drive so that the following coins can be returned onto the rotatable disk and, after the following coins have been returned onto the rotatable disk, sets the space between said pair of guide plate means larger than the largest diameter of coins to be handled, drives said first stopper means and said second stopper means in the reverse direction and drives said coin transporting means so as to feed said unacceptable coin toward said rotatable disk.

2. An unacceptable coin removing apparatus for a coin handling machine in accordance with claim 1 wherein each of said guide plate means comprises a guide plate extending in a direction in which coins are transported and a guide rail secured to the guide plate and capable of supporting an edge of the coins.

3. An unacceptable coin removing apparatus for a coin handling machine in accordance with claim 2 which further includes space adjusting means driven by said control means and capable of moving said guide plates by the same distance in the opposite directions.

* * * * *